US005357720A

United States Patent [19]

O'Keeffe et al.

[11] Patent Number: 5,357,720

[45] Date of Patent: Oct. 25, 1994

[54] SKYLIGHT SILL WITH BUILT-IN REGLET FOR REMOVABLE FLASHING

[75] Inventors: William F. O'Keeffe; Sonny Q. Garcia, both of San Francisco, Calif.

[73] Assignee: O'Keeffe's Inc., San Francisco, Calif.

[21] Appl. No.: 93,776

[22] Filed: Jul. 19, 1993

[51] Int. Cl.[5] ..... E04D 13/14

[52] U.S. Cl. ..... 52/58; 52/200

[58] Field of Search ..... 52/58–61, 52/200

[56] References Cited

U.S. PATENT DOCUMENTS

| | | | |
|---|---|---|---|
| 3,241,271 | 3/1966 | Berg | 52/58 |
| 3,256,650 | 6/1966 | Weckerly et al. | 52/58 |
| 4,165,589 | 8/1979 | de Cateret | 52/61 |
| 4,190,989 | 3/1980 | Sakharoff et al. | 52/60 |
| 5,123,208 | 6/1992 | Kirby et al. | 52/58 |

FOREIGN PATENT DOCUMENTS

| | | | |
|---|---|---|---|
| 6700748 | 1/1968 | Netherlands | 52/200 |

OTHER PUBLICATIONS

O'Keeffe's, Inc., "*The Terminator TM*", Aug. 1990, Specifying Guide.

*Primary Examiner*—James L. Ridgill, Jr.
*Attorney, Agent, or Firm*—Fliesler, Dubb, Meyer & Lovejoy

[57] ABSTRACT

A reglet and flashing assembly for preventing water from penetrating between a roofing membrane at its exposed edge and a skylight curb on which the membrane is provided. The assembly includes a reglet which is permanently anchored to or integrally formed as part of, the skylight sill. The reglet serves as an anchor for a flashing which has an upper edge removably attached to the reglet. The flashing overhangs the roofing membrane and a lower edge of the flashing is biased against the membrane to act as a protective shield to prevent water from entering between the roofing membrane and the skylight curb. The present invention further includes a flexible gasket fitting into the joint between the reglet and the flashing to secure the flashing in proper position. The gasket may be removed to thereby free the flashing. After the flashing has been removed, no part of the reglet and flashing assembly is in contact with the roofing membrane on the skylight sill, and the membrane may then be quickly and easily repaired or replaced.

22 Claims, 5 Drawing Sheets

SKYLIGHT SILL WITH BUILT-IN REGLET FOR REMOVABLE FLASHING

BACKGROUND OF THE INVENTION

1. Field of The Invention

The present invention relates to a reglet and flashing assembly, and in particular, a reglet and flashing assembly for use with a skylight sill, in which the flashing may be removed to allow quick and easy repair or replacement of the roofing membrane underneath.

2. Description of the Related Art

In building construction, with chimneys, parapets, or other such structures located on a roof, the roofing material or membrane protecting the roof is provided around at least the base of the roof structure to prevent moisture from penetrating into the joint between the roof structure and the roof. In order to prevent moisture from entering between the roofing membrane and the roof structure where the roofing membrane ends, a flashing is commonly provided to overhang and protect the otherwise exposed edge portion of the membrane. A conventional flashing extends around the entire perimeter of the roof structure with an upper edge anchored to the structure and a lower edge overhanging the roofing membrane to thereby shield the membrane underneath against moisture and precipitation. Flashings are commonly constructed of aluminum or other sturdy, durable material.

The flashing can be secured to the roof structure at its upper edge by means of an anchoring device, such as a screw or reglet. Conventional reglets are fastened to the roof structure by nails, screws, anchors or similar fastening devices, depending on the particular design and the material into which the reglet is anchored. The flashing is in turn permanently or detachably affixed to the reglet. Typical reglet and flashing assemblies are disclosed in U.S. Pat. No. 5,123,208 to Kirby et al. and in U.S. Pat. No. 4,190,989 to Sakharoff.

A disadvantage of conventional flashings is that it is difficult to repair or remove the roofing membrane located underneath the flashing. Often the nail, screw or anchor securing the flashing to the roof structure is inserted through the roofing membrane. Therefore, in order to repair or replace the membrane, the flashing securing mechanism must first be removed. This is a time consuming and expensive process, which additionally often results in the need to replace the fastening.

With specific regard to skylights, as shown in FIG. 1, such structures generally rest on a curb 12 having roofing membrane 10 provided thereon. In conventional skylight systems, the skylight 15 includes a sill 16 affixed to or extruded as part of the skylight frame. The sill 16 in conventional systems overhangs the roofing membrane with a lip 14 at a bottom portion to shield the edge portion of membrane 10. A fastening device, such as screw 18, is used to secure the sill 16 and skylight 15 to the curb 12. Such screws have conventionally been fastened through the roofing membrane 10. Thus, as described above, repair or replacement of the roofing membrane 10 is a timely and costly procedure, requiring removal of the fastening means 18 and often the skylight itself.

SUMMARY OF THE INVENTION

It is therefore an object of the present invention to provide a reglet and flashing assembly for use with a roof structure such as a skylight sill.

It is a further object of the present invention that the reglet and flashing assembly, and the sill be integrally formed as part of the skylight frame.

It is a still further object of the present invention to provide a flashing which may be quickly and easily removed from the reglet.

It is another object of the present invention to provide a flashing which may be reused and quickly and easily reattached after the roofing repairs have been completed.

It is a still further object of the present invention to allow the roofing membrane under the flashing to be quickly and easily removed or repaired without having to remove the skylight sill or lift the skylight.

These and other objects are accomplished by the present invention which relates to a reglet and flashing assembly for preventing water from penetrating between a roofing membrane at its exposed edge and the skylight curb on which the membrane is provided. The assembly includes a reglet which can be integrally formed as part of the skylight sill. The reglet serves as an anchor for a flashing which has an upper edge removably attached to the reglet. The flashing overhangs the roofing membrane and a lower edge of the flashing is biased against the membrane to act as a protective shield to prevent water from entering between the roofing membrane and the skylight curb. The present invention further includes a flexible gasket fitting into the joint between the reglet and the flashing to secure the flashing in proper position.

When the gasket is in place, the reglet and flashing assembly provides a water proof seal against water seepage. However, when it becomes necessary to repair or replace the roofing membrane beneath the flashing, the gasket and the flashing may be removed to allow access to the membrane. Once the flashing has been removed, no part of the reglet and flashing is in contact with the roofing membrane, and repair or replacement of the membrane may then be quickly and easily accomplished. Moreover, the design of the present invention allows the same flashing and gasket to be reused upon completion of work on the membrane.

BRIEF DESCRIPTION OF THE DRAWINGS

The invention will now be described with reference to the drawings in which.

DETAILED DESCRIPTION OF A PREFERRED EMBODIMENT

Figure 1:
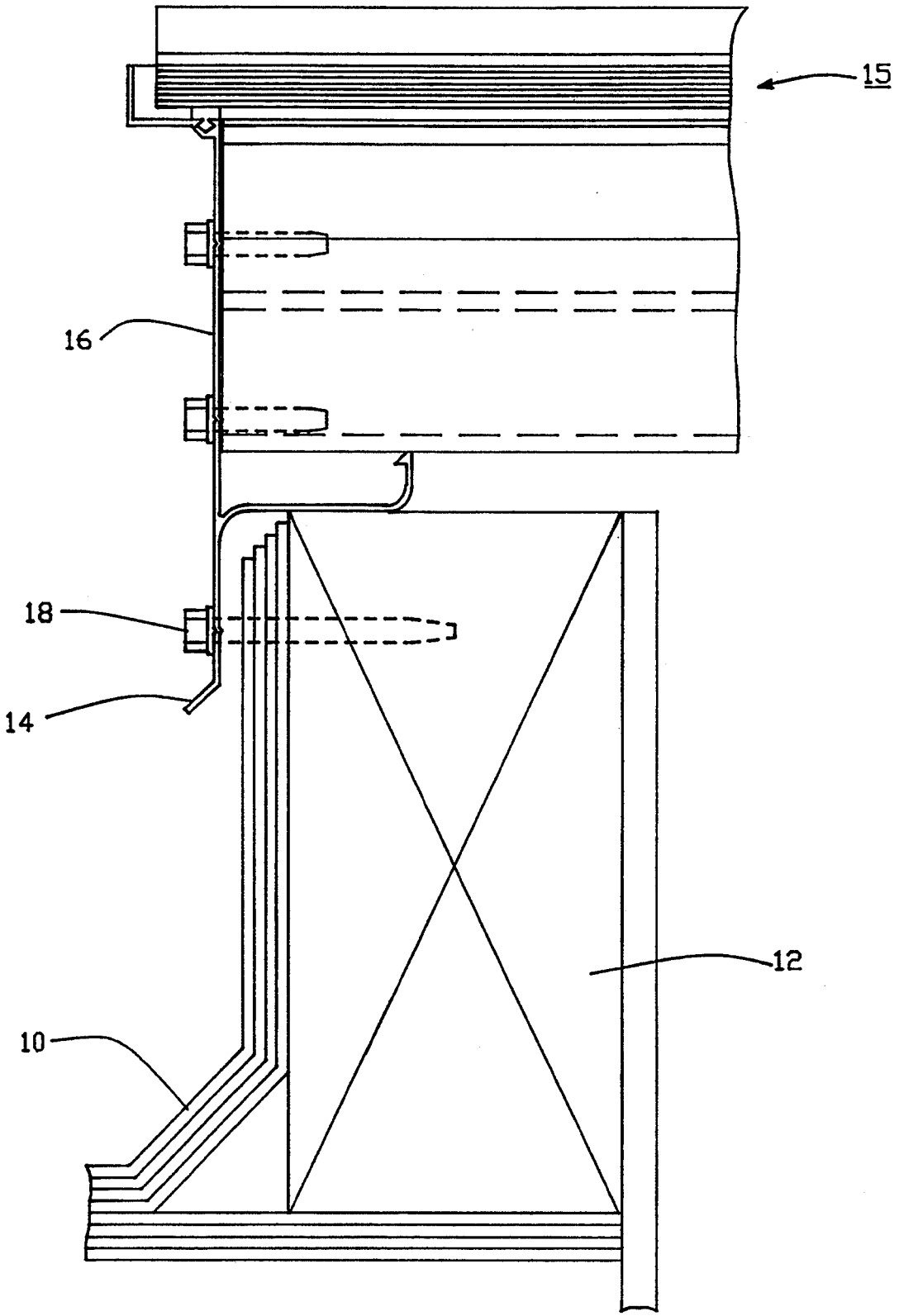
(PRIOR ART) FIG.—1
FIG. 1 is a side cross-sectional view showing a prior art skylight sill on a roof.
Figure 2:
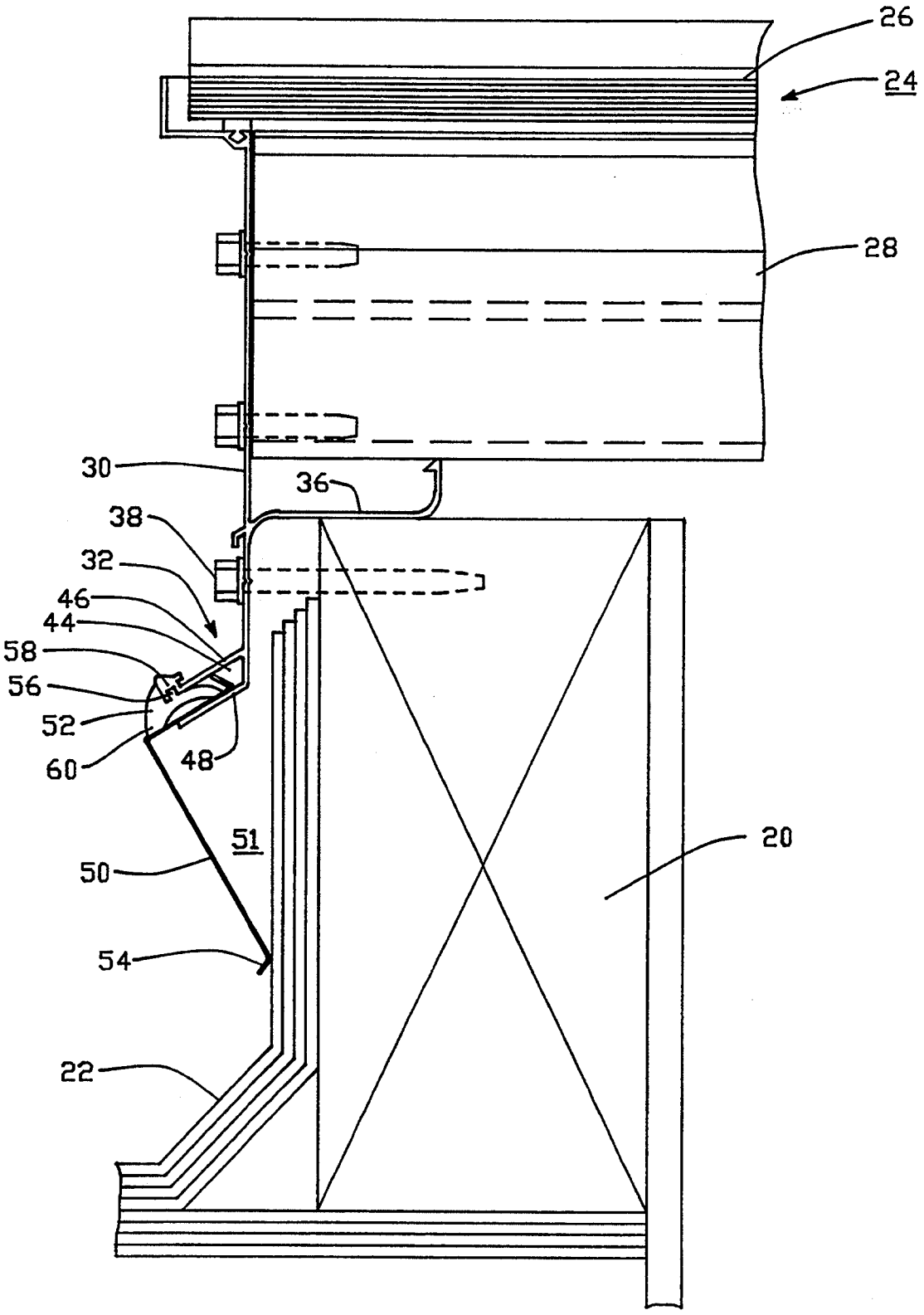
FIG. 2 is a side cross-sectional view showing a skylight sill on a roof with a built-in reglet and flashing assembly of the present invention.

Referring now to the drawings, and in particular FIG. 2 there is shown a portion of a skylight curb 20 having roofing membrane 22 affixed thereon. While the present invention is described for use with a skylight curb, it is understood that it may alternatively be used with a parapet, chimney or any other structure provided on a roof. The present invention may operate in the presence of any conventional roofing membrane 22, and the membrane 22 may include a plurality of layers. FIG. 2 shows a skylight assembly 24, including skylight 26 and skylight frame 28. The reglet and flashing assembly of the present invention may be configured to operate with a flat-type skylight assembly, such as that shown in FIG. 2 or a sloping-type skylight assembly, such as that shown in FIG. 3.

The present invention includes a sill 30 provided on frame 28. Sill 30 may be extruded as part of frame 28 so that sill 30 and frame 28 form a single unitary extrusion. Alternatively, sill 30 may be permanently affixed to frame 28 via screws, nails, anchors or other conventional affixing means (not shown). Sill 30 overhangs membrane 22 and may include a screw 38 fitted through a hole in sill 30 and into curb 20. The screw 38 extends into curb 20 at a point above the edge portion of roofing membrane 22. Thus, screw 38 does not contact membrane 22. Screw 38 serves to maintain a proper positioning of, and add structural rigidity to sill 30. Sill 30 may be formed out of any of several materials having a high strength and durability, such as for example, aluminum or high strength plastics such as extruded high impact polycarbonates.

Built-in reglet 32 is preferably provided at a lower portion of sill 30 and integrally formed therewith so that sill 30 and reglet 32 comprise a single unitary extrusion. Alternately reglet 32 could be formed separately and secured with a fastener to sill 30. Reglet 32 is comprised of a channel 44 defined by flanges 46 and 48. As explained in greater detail below, channel 44 receives an upper portion of flashing 50 and, together with gasket 52, serves to anchor flashing 50 in proper position with respect to roofing membrane 22. Reglet 32 is preferably formed from the same material as sill 30, such as aluminum or high strength plastics.

Sill 30 further includes perpendicular member 36 which extends substantially perpendicularly to the main portion of sill 30 into the joint between skylight assembly 24 and curb 20. Perpendicular member 36 rests on an adhesive material (not shown) provided on the upper surface of curb 20. The perpendicular member 36 is held by the adhesive, thereby further securing sill 30 and skylight 24 in place.

Figure 3:
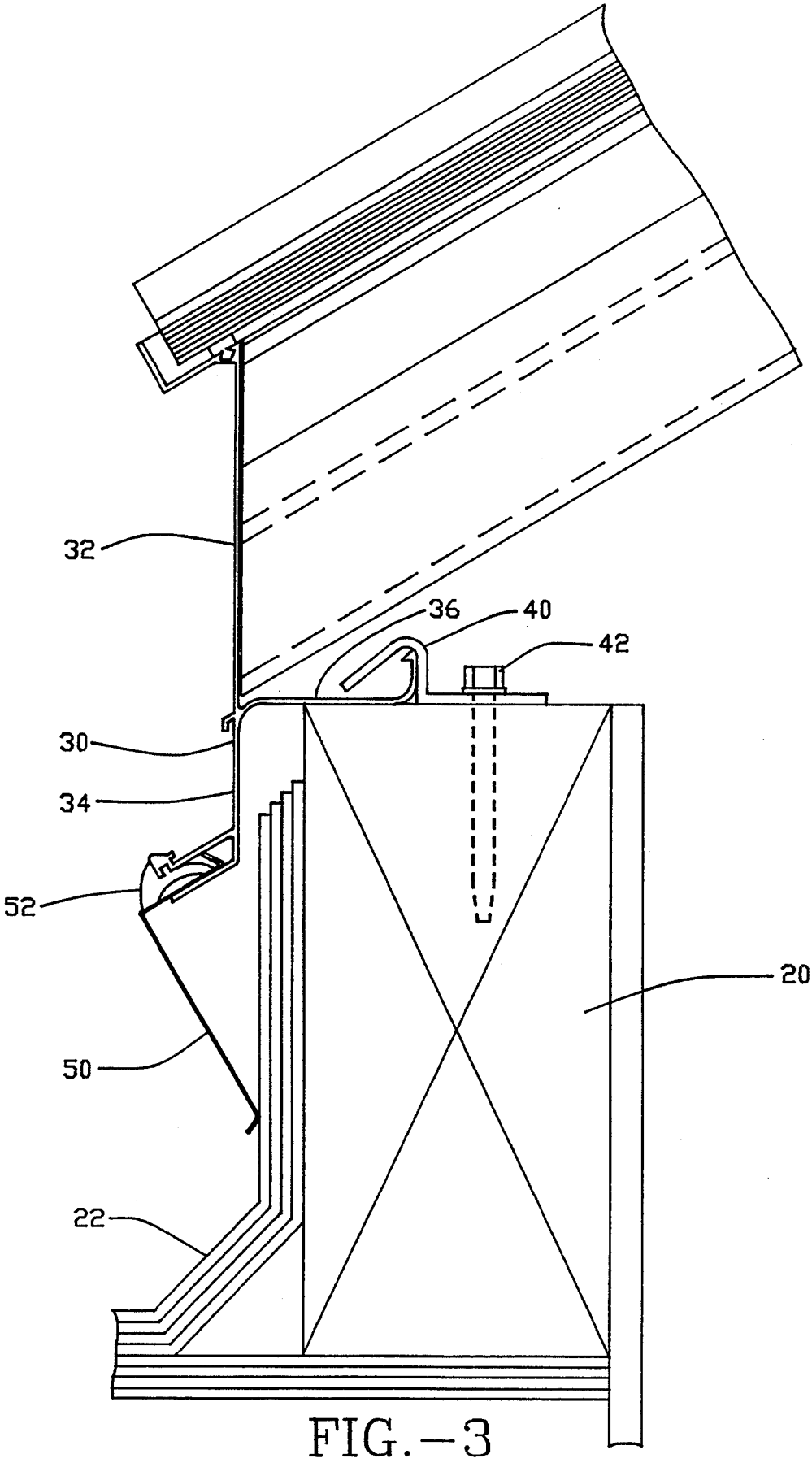
FIG. 3 is a side cross-sectional view showing an alternative skylight sill on a roof with a built-in reglet and flashing assembly according to the present invention.

In the embodiment shown in FIG. 2, the skylight 24 may preferably lie flat on top of skylight curb 20. However, in an alternative embodiment shown in FIG. 3, skylight 24 may be provided at an inclined angle with respect to curb 20. In this embodiment, perpendicular member 36 may be received and secured by hook member 40 in addition to the adhesive material. Hook member 40 may be secured to curb 20 by screw 42 fitting through a hole in hook member 40 and received in the top portion of curb 20. While FIG. 3 shows reglet 32 secured to curb 20 by means of hook member 40 and screw 42, it is understood that this embodiment may alternatively use a fastening means such as screw 38 shown in FIG. 2 to fasten reglet 32 to curb 20. Similarly it is understood that the reglet 32 shown in FIG. 2 may be attached to curb 20 by means of a hook member 40 and screw 42 such as shown in FIG. 3.

Figure 4:
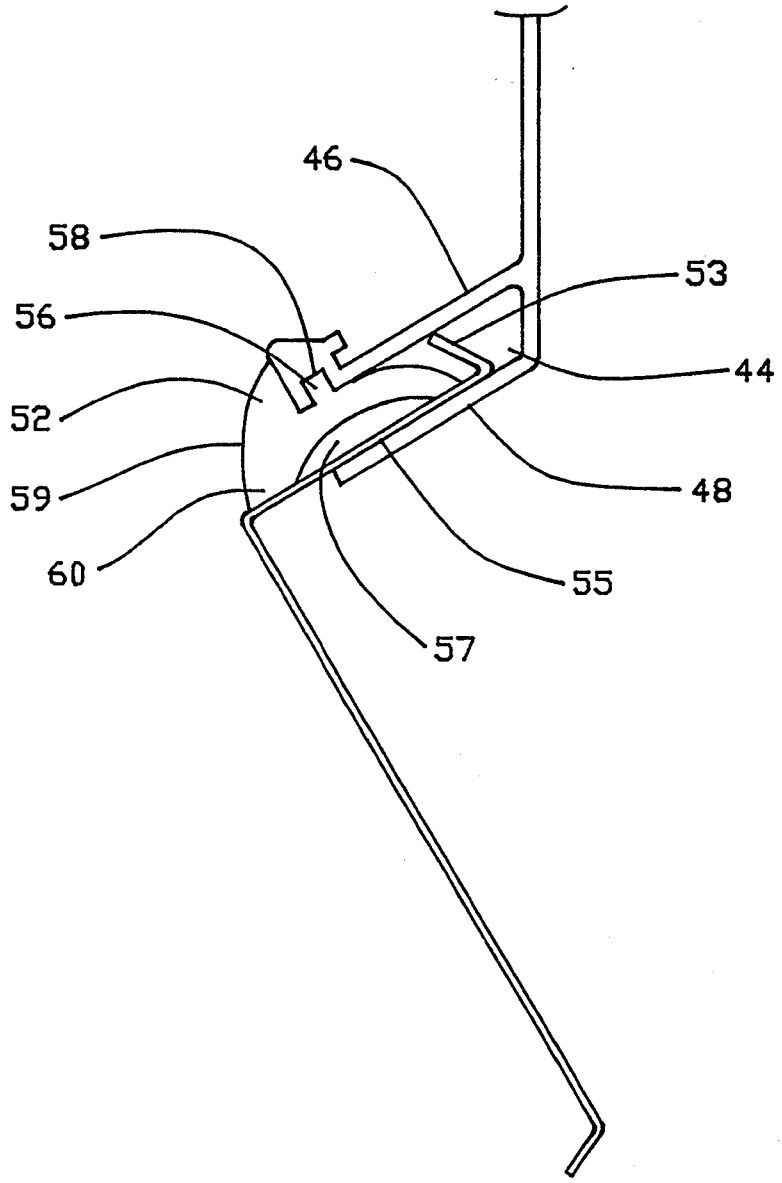
FIG. 4 is an enlarged side cross-sectional view showing the reglet and flashing assembly of the present invention.

With reference to FIGS. 2 through 4, channel 44 of reglet 32 is provided to receive a removable flashing 50. Flashing 50 is of a conventional material and design and is provided to prevent water and debris from entering into the space 51 between flashing 50 and roofing membrane 22. Such flashings are manufactured and sold by assignee of the present invention. The upper portion of flashing 50 is received in channel 44 and secured therein by gasket 52 and lock flange 53 as explained hereinafter. The lower portion of flashing 50 includes a lip 54 which is biased against roofing membrane 22 to thereby prevent water or debris from penetrating past lip 54 into the space 51.

As shown in FIG. 4, the upper portion of flashing 50 is removably secured in channel 44 by means of gasket 52 and lock flange 53. Lock flange 53 is provided with a length and an angle with respect to the adjacent portion 55 of flashing 50 so that lock flange 53 and portion 55 fit snugly within channel 44. Gasket 52 is inserted into channel 44 after flashing 50 has been inserted so that gasket 52 locks flashing 50 with channel 44. Gasket 52 may be formed of any of several elastomers having high elasticity and resistance to wear and break down. One such preferred material is extruded neoprene. Gasket 52 is formed with a protrusion 56 which is received in a groove 58 in flange 46 upon proper positioning of gasket 52. Gasket 52 is provided to fit snugly in channel 44 and the coupling of protrusion 56 with groove 58 secures both gasket 52 and flashing 50 within channel 44. When flashing is properly positioned within channel 44, the lower portion of flashing 50, lip 54, is biased against roofing membrane 22. The tight fit of gasket 52 in channel 44 induces a downward force in proximal portion 60 of gasket 52 upon flashing 50 which serves to further bias the lower portion of flashing 50 against roofing membrane 22. The positioning of flashing 50 and the force exerted by proximal portion 60 are sufficient to maintain a constant integral contact between the lower portion of flashing 50 and roofing membrane 22 so as to prevent entry of moisture and debris into space 51.

When it is desired to remove roofing membrane 22 from underneath flashing 50, flashing 50 may be quickly and easily detached. The bottom surface of gasket 52 is provided with an arcuate section so as to leave a hollow cavity 57 between gasket 52 and portion 55 adjacent to flange 48. As gasket 52 is of flexible material, by exerting pressure on exposed surface 59 of gasket 52, gasket 52 may be pressed down into cavity 57, thereby freeing protrusion 56 from groove 58. Thereupon, gasket 52 and flashing 50 may be removed from channel 44.

After the flashing 50 has been removed, no part of the reglet and flashing assembly is in contact with roofing membrane 22, and repair or replacement of membrane 22 may be easily accomplished. As gasket 52 is comprised of shape-memory material, it may be reused if the gasket is in good repair. Once repair or replacement of roofing membrane 22 has been completed, flashing 50 and gasket 52 (or a similar replacement gasket) may be quickly and easily reinserted and secured in channel 44 as described above.

Figure 5:
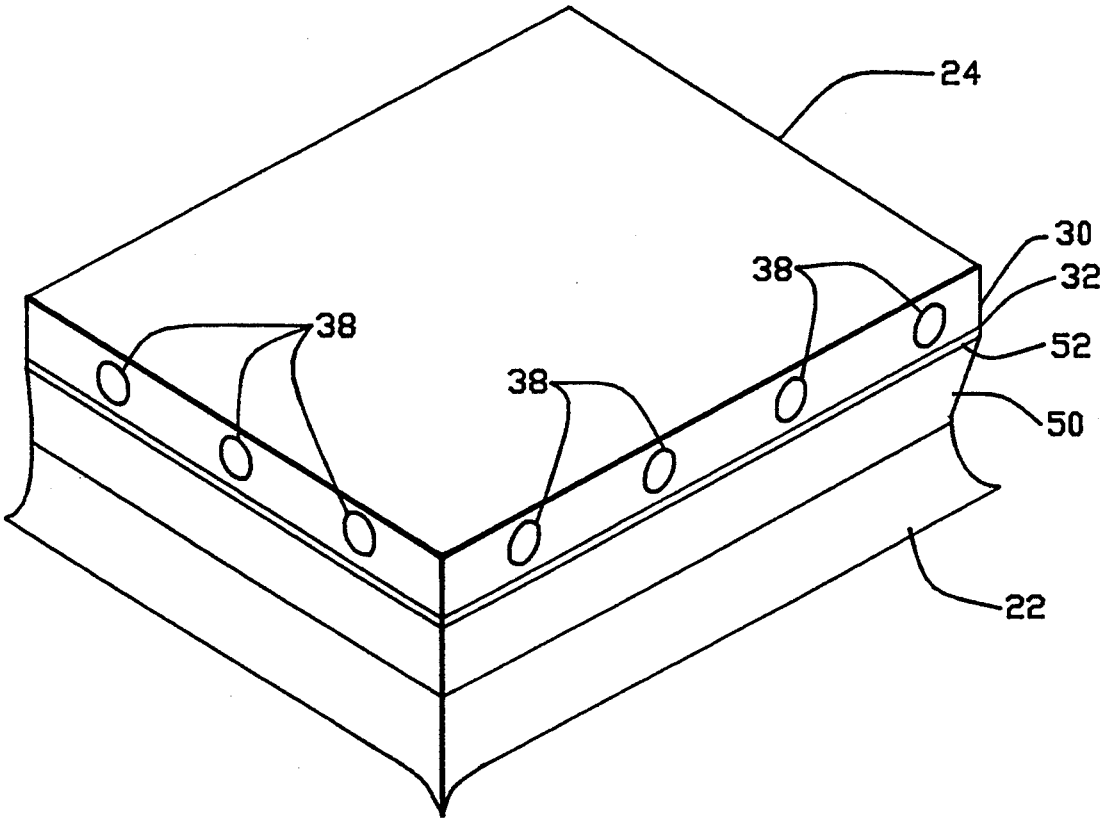
FIG. 5 is an isometric view showing a skylight sill on a roof with a built-in reglet and flashing assembly according to the present invention.

As shown in part on FIG. 5, sill 30, reglet 32, flashing 50 and gasket 52 extend around the entire perimeter of skylight 24. The present invention allows the flashing 50 to be quickly detached from the reglet by removal of the gasket 52, and once detached, the membrane 22 may be quickly and easily removed without having to remove the sill 30 at each screw fastening point 38. Thus, relative to conventional skylight fastening techniques, the present invention offers a reduction in the time and expense formerly required to repair or replace a roofing membrane. Moreover, extruding a skylight sill so as to integrally include a reglet for receiving a flashing provides an improved skylight construction which may be quickly and easily installed.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

We claim:

1. A roofing system for preventing moisture from penetrating between a roofing membrane and a skylight curb supporting a skylight, comprising:

a flashing for covering at least an edge portion of the roofing membrane;

a reglet provided around the skylight curb for removably securing said flashing in proper position with respect to said roofing membrane edge portion, said flashing and said reglet together seal the edge portion against moisture penetration between said roofing membrane and said skylight curb, wherein upon detachment of said flashing from said reglet, no part of the roofing system is in contact with the roofing membrane; and a removable gasket for removably securing said flashing to said reglet.

2. The roofing system recited in claim 1, further comprising a sill provided around the skylight curb, said reglet being integrally formed as part of said sill.

3. The roofing system recited in claim 2, further comprising fastening means provided through said sill and into the skylight curb for securing said sill to the skylight curb, wherein no part of said fastening means contacts the roofing membrane.

4. The roofing system of claim 1, further comprising:

a channel defined by said reglet for receiving a portion of said flashing therein; and said gasket fitting snugly in said channel to secure said portion of said flashing in said channel.

5. The roofing system of claim 4, wherein said flashing may be detached from said reglet by removing said gasket from said channel.

6. The roofing system of claim 5, wherein said flashing and said gasket may be reused after said flashing and said gasket have been removed from said channel by reinserting said flashing and said gasket into said channel.

7. A roofing system for preventing moisture from penetrating between a roofing membrane and a skylight curb supporting a skylight, comprising:

flashing means for covering at least an edge portion of the roofing membrane;

reglet means provided around the skylight for removably securing said flashing means in proper position with respect to said edge portion, said flashing means and said reglet means together seal the edge portion against moisture penetration between said roofing membrane and said skylight curb, wherein upon detachment of said flashing means from said reglet means, no part of the roofing system is in contact with the roofing membrane.

8. The roofing system recited in claim 7, wherein said reglet means is integrally formed as part of the skylight.

9. The roofing system recited in claim 7, further comprising a sill integrally formed as part of the skylight, said sill and said reglet means being extruded as a single unit.

10. The roofing system of claim 7, further comprising:

a channel formed in a section of said reglet means for receiving a portion of said flashing means therein; and a gasket fitting snugly in said channel to secure said portion of said flashing means in said channel.

11. The roofing system of claim 10, wherein said flashing means may be detached from said reglet means by removing said gasket from said channel.

12. The roofing system of claim 11, wherein said flashing means and said gasket may be reused after said flashing means and said gasket have been removed from said channel by reinserting said flashing means and said gasket into said channel.

13. The roofing system recited in claim 10, wherein said gasket is comprised of an elastomer.

14. The roofing system recited in claim 13, wherein said elastomer is extruded neoprene.

15. A roofing system for preventing moisture from penetrating between a roofing membrane and a skylight curb supporting a skylight, comprising:

a reglet integrally formed as part of the skylight, said reglet including receiving means;

a flashing removably secured in said receiving means for covering at least an edge portion of the roofing membrane, said flashing and said reglet together seal the edge portion against moisture penetration between said roofing membrane and said skylight curb.

16. The roofing system recited in claim 15, further comprising a sill integrally formed as part of the skylight, said reglet being formed as part of said sill.

17. The roofing system recited in claim 15, further comprising fastening means through the skylight into the skylight curb for securing the skylight to the skylight curb, wherein no part of said fastening means contacts the roofing membrane.

18. The roofing system of claim 15, further comprising a gasket received in said receiving means for removably securing said flashing in said receiving means.

19. The roofing system of claim 18, wherein said flashing may be detached from said reglet by removing said gasket from said channel.

20. A roofing system for preventing moisture from penetrating between a roofing membrane and a skylight curb supporting a skylight, comprising:

a reglet integrally formed as part of the skylight, said reglet including receiving means;

a flashing including a portion removably secured in said receiving means, said flashing covering at least an edge portion of the roofing membrane, said flashing and said reglet together seal the edge portion against moisture penetration between said roofing membrane and said skylight curb; and a gasket fitting snugly in said receiving means to secure said portion of said flashing in said receiving means, wherein upon detachment of said flashing from said reglet by removal of said gasket, no part of the roofing system is in contact with the roofing membrane.

21. The roofing system of claim 20, further comprising a sill integrally formed as part of the skylight around a perimeter of the skylight, said sill extending down from the skylight to overhang the curb, said reglet being formed as part of said sill.

22. The roofing system of claim 20, wherein said flashing and said gasket may be reused after said flashing and said gasket have been removed from said channel by reinserting said flashing and said gasket into said channel.

* * * * *